US008376652B2

(12) United States Patent
Bradford

(10) Patent No.: US 8,376,652 B2
(45) Date of Patent: Feb. 19, 2013

(54) ZONE EQUIDISTANCE CONTROL EXPANSION JOINT SYSTEM

(75) Inventor: Paul Bradford, West Falls, NY (US)

(73) Assignee: Construction Research & Technology GmbH (DE)

( * ) Notice: Subject to any disclaimer, the term of this patent is extended or adjusted under 35 U.S.C. 154(b) by 0 days.

(21) Appl. No.: 12/965,331

(22) Filed: Dec. 10, 2010

(65) Prior Publication Data

US 2011/0217119 A1 Sep. 8, 2011

Related U.S. Application Data

(60) Provisional application No. 61/285,334, filed on Dec. 10, 2009.

(51) Int. Cl.
*E01C 11/02* (2006.01)

(52) U.S. Cl. ..... 404/70; 14/47; 14/51; 14/53

(58) Field of Classification Search ..... 404/47–70
See application file for complete search history.

(56) References Cited

U.S. PATENT DOCUMENTS

| | | | | |
|---|---|---|---|---|
| 3,604,322 | A * | 9/1971 | Koster | 404/53 |
| 4,030,156 | A * | 6/1977 | Raymond | 14/73.1 |
| 4,075,728 | A * | 2/1978 | Puccio | 14/73.1 |
| 4,516,284 | A | 5/1985 | Huber et al. | |
| 4,674,912 | A * | 6/1987 | Buckenauer | 404/56 |
| 5,302,050 | A * | 4/1994 | Buckenauer et al. | 404/53 |
| 5,887,308 | A * | 3/1999 | Walter | 14/73.1 |
| 5,964,069 | A * | 10/1999 | Schmidt | 52/396.05 |
| 6,125,596 | A * | 10/2000 | Goto | 52/167.4 |
| 6,418,677 | B1 * | 7/2002 | Goto | 52/167.1 |
| 6,912,751 | B2 * | 7/2005 | Steiger et al. | 14/73.1 |
| 6,931,807 | B2 * | 8/2005 | Braun | 52/393 |
| 7,252,454 | B2 * | 8/2007 | Bradford et al. | 404/47 |
| 7,395,570 | B2 * | 7/2008 | Bradford et al. | 14/73.1 |

FOREIGN PATENT DOCUMENTS

| | | |
|---|---|---|
| DE | 34 38 517 | 7/1985 |
| EP | 0 090 986 | 10/1983 |
| EP | 0 338 124 | 10/1989 |

OTHER PUBLICATIONS

PCT/US2010/059908—International Search Report, Mar. 23, 2011.
PCT/US2010/059908—Written Opinion, Mar. 23, 2011.

* cited by examiner

*Primary Examiner* — Raymond W Addie
(74) *Attorney, Agent, or Firm* — Curatolo Sidoti Co., LPA; Salvatore A. Sidoti; Julie D. Hawk

(57) ABSTRACT

A modular-type expansion joint system for bridging a gap that is located between spaced-apart structural members. The expansion joint system may be utilized, for example, in bridges, highways, and tunnel constructions where gaps are formed between spaced-apart, adjacent concrete sections. The expansion joint system includes vehicular load bearing members and support members. Seals are located between the vehicular load bearing members. The expansion joint system includes zones of differing movement capabilities in response to displacement events.

15 Claims, 1 Drawing Sheet

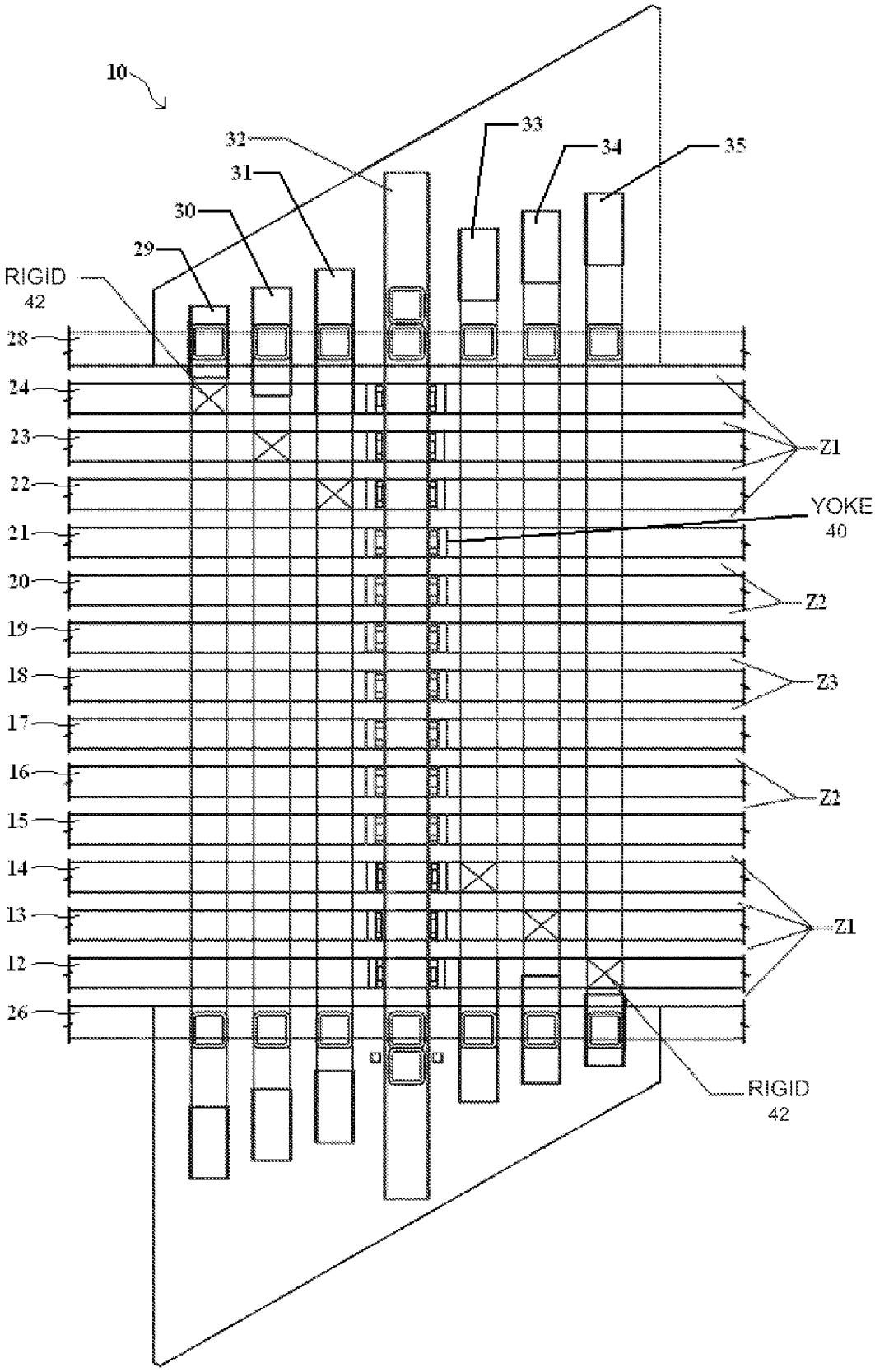
10
32
33
34
35
31
30
29
RIGID
42
28
24
23
22
21
20
19
18
17
16
15
14
13
12
26
Z1
YOKE
40
Z2
Z3
Z2
Z1
RIGID
42

ZONE EQUIDISTANCE CONTROL EXPANSION JOINT SYSTEM

CROSS REFERENCE TO RELATED APPLICATIONS

This application claims the benefit of the filing date under 35 U.S.C. §119(e) from U.S. Provisional Application Ser. No. 61/285,334 filed on Dec. 10, 2009, which is incorporated by reference.

TECHNICAL FIELD

Disclosed is an expansion joint system for bridging a gap that is located between spaced-apart structural members.

BACKGROUND

An opening or gap is purposely provided between adjacent concrete structures for accommodating dimensional changes within the gap occurring as expansion and contraction due to temperature changes, shortening and creep of the concrete caused by prestressing, seismic cycling and vibration deflections caused by live loads, and longitudinal forces caused by vehicular traffic. An expansion joint system is conventionally installed in the gap to provide a bridge across the gap and to accommodate the movements in the vicinity of the gap.

Bridge and roadway constructions are especially subject to relative movement in response to the occurrence of thermal changes, seismic events, and vehicle loads. This raises particular problems, because the movements occurring during such events are not predictable either with respect to the magnitude of the movements or with respect to the velocity of the movements. In some instances bridges have become unusable for significant periods of time, due to the fact that traffic cannot travel across damaged expansion joints.

Modular expansion joint systems typically employ a plurality of spaced-apart, load bearing members or "centerbeams" extending transversely relative to the direction of vehicle traffic. The top surfaces of the load bearing members are engaged by the vehicle tires. Elastomeric seals extend between the load bearing members adjacent the tops of the load bearing members to fill the spaces between the load bearing members. These seals are flexible are therefore stretch and contract in response to movement of the load bearing members. A plurality of elongated, longitudinal support members are positioned below the transverse load bearing members spanning the expansion gap between the roadway sections. The elongated support members support the transverse load bearing members. Each end of the support members is received in a housing embedded in the roadway sections.

In single support bar (SSB) modular expansion joint systems, a single support member is connected to all the transverse load bearing members. The load bearing member connection to the single support bar member commonly consists of a yoke. The yoked connection of the single support bar member to a plurality of transverse load bearing members provides a sliding or pivoting connection in the SSB modular expansion joint systems. In a multiple support bar (MSB) modular expansion joint system, each transverse vehicular load bearing member (ie, each "centerbeam") is connected to a single longitudinal support bar member.

In MSB systems, the friction forces for the left edge beam and right edge beam oppose each other. If the forces are close or equal in magnitude, then they essentially cancel each other out. The spring forces govern, qualitatively the MBS system can be approximated as a series arrangement of spring.

In SSB systems, the SSB centerbeam virtually always experiences yoke friction resisting movement towards equilibrium and has no neutralizing friction force as in the MSB system. SSB systems rely on traffic vibration to dynamically "shake down" strain energy in the springs to restore equilibrium (referred to as stagnation zone movement. Accordingly, SSB systems often display a fanning type equidistance, where the first cell on the active side opens the greatest, the second a less than the first, the third less than the second, etc . . . .

Because of friction force differences, SSB systems and MSB systems using equidistance springs respond differently. SSB systems perform well in slow movements applications, for example bridge structure thermal movements. MSB systems are inherently better suited to accommodate faster movements, such as bridge superstructure flexure due to changes in vehicular loading position.

MSB systems are subject to size constraints. A design point is reached where the use of multiple support bars take up too much room and will not fit on the structure. Hence large structures often use SSB designs, but they do not perform as well as MSB systems in high speed environments.

BRIEF DESCRIPTION OF THE DRAWING

FIG. 1 is a schematic of the underside of an illustrative embodiment of the expansion joint system.

DETAILED DESCRIPTION

Provided is a modular-type expansion joint system located within a gap defined between adjacent first and second structural members. The disclosed expansion joint system may be used in a wide variety of large or small movement applications. The expansion joint system comprises a plurality of vehicle load bearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members. The expansion joint system includes a plurality of different zones in which the movement of the vehicular load bearing members in a particular zone occurs in response to a different level of movement within the structure to maintain equidistance or otherwise control the distance between the vehicular load bearing members. The selection of joint zone parameters allows the system expansion behavior to be synchronized with structural movements. This tailoring of equidistance behavior to structural behavior can be accomplished by using a zoned equidistance control system.

According to certain illustrative embodiments, the expansion joint system comprises a plurality of vehicle load bearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members, at least one first zone in which the movement of the vehicular load bearing members in the first zone occurs in response to a first level of movement of the structure and at least one second zone in which the movement of the vehicular load bearing members in the second zone occurs in response to a second level of movement of the structure which is greater than the first level of movement of the structure.

According to further illustrative embodiments, the expansion joint system comprises a plurality of vehicle load hearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members, at least one first zone in which the movement of the vehicular load bearing members in the first zone occurs in response to a first level of movement of the structure, at least one second zone in which the movement of the vehicular load bearing members in the second zone occurs in response to a second level of movement of the structure which is greater than the first level of movement of the structure, and at least one third zone in which the movement of the vehicular load bearing members in the third zone occurs in response to a third level of movement of the structure which is greater than both the first and second levels of movement of the structure.

Also disclosed is an expansion joint comprising spaced-part structural members and an expansion joint system bridging the gap between the structural members, the expansion joint system comprises a plurality of vehicle load bearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members, at least one first zone in which the movement of the vehicular load bearing members in the first zone occurs in response to a first level of movement of the structure and at least one second zone in which the movement of the vehicular load bearing members in the second zone occurs in response to a second level of movement of the structure which is greater than the first level of movement of the structure.

According to illustrative embodiments, the expansion joint comprises spaced-part structural members and an expansion joint system bridging the gap between the structural members, the expansion joint system comprises a plurality of vehicle load bearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members, at least one first zone in which the movement of the vehicular load bearing members in the first zone occurs in response to a first level of movement of the structure, at least one second zone in which the movement of the vehicular load bearing members in the second zone occurs in response to a second level of movement of the structure which is greater than the first level of movement of the structure, and at least one third zone in which the movement of the vehicular load bearing members in the third zone occurs in response to a third level of movement of the structure which is greater than both the first and second levels of movement of the structure.

Also disclosed is a method for making an expansion joint, the method comprising installing an expansion joint system in a gap located between spaced-apart structural members, the expansion joint system comprises a plurality of vehicle load bearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members, at least one first zone in which the movement of the vehicular load bearing members in the first zone occurs in response to a first level of movement of the structure and at least one second zone in which the movement of the vehicular load bearing members in the second zone occurs in response to a second level of movement of the structure which is greater than the first level of movement of the structure.

According to illustrative embodiments, the method for making an expansion joint comprises installing an expansion joint system in a gap located between spaced-apart structural members, the expansion joint system comprises a plurality of vehicle load bearing members extending transverse to the direction of traffic crossing the expansion joint gap, a plurality of elongated support members that are positioned below the transversely extending load bearing members and extend longitudinally across the expansion joint gap, and housings for receiving the opposite longitudinal ends of the elongated support bar members, at least one first zone in which the movement of the vehicular load bearing members in the first zone occurs in response to a first level of movement of the structure, at least one second zone in which the movement of the vehicular load bearing members in the second zone occurs in response to a second level of movement of the structure which is greater than the first level of movement of the structure, and at least one third zone in which the movement of the vehicular load bearing members in the third zone occurs in response to a third level of movement of the structure which is greater than both the first and second levels of movement of the structure.

The expansion joint system comprises transversely extending vehicular load bearing members having top surfaces that are exposed to traffic and bottom surfaces opposite from the top surfaces. The expansion joint system further includes elongated support members that are positioned below the transversely extending load bearing member within the expansion joint gap between spaced-apart structural members. The elongated support members extend longitudinally across the expansion joint gap from the first structure to the second structure.

The opposite longitudinal ends of the longitudinally extending support members are received in housings that are embedded in the spaced-apart structural members. Without limitation, the first and second housings for accepting the ends of the elongated support members extending longitudinally across said gap may comprise a box-like receptacle. It should be noted, however, that the housings for accepting the ends of the support bar members may include any structure such as, for example, receptacles, chambers, containers, enclosures, channels, tracks, slots, grooves or passages, that includes a suitable cavity for accepting the end portions of the support bar members.

The housings are provided to accommodate the movement of the support bar members and to accommodate changes in expansion joint gap width. According to certain illustrative embodiments, the housings may accommodate certain types of the movement while restricting other types of movement. For example, the expansion joint system may include a first housing for accepting an end of a support member for substantially restricting transverse movement within the first housing but permitting longitudinal and vertical movement within the first housing, and a second housing for accepting the opposite end of the elongated support member for substantially restricting longitudinal movement within the second means housing, but permitting transverse and vertical movement within the second housing.

The expansion joint system may also include flexible and compressible seals extending between the load bearing member and edge members that are engaged with first and second structural members. According to certain embodiments of the expansion joint system, the system includes flexible and compressible seals extending between the load bearing members and between the load bearing members and the edge members of the system. Useful seals include, without limitation, strip seals, glandular seals, and membrane seals.

The control of equidistance between the vehicular load bearing members of the modular expansion joint system may be achieved through the use of a hybrid of a single support bar modular system and a multiple support bar modular system. According to this hybrid modular system at least one single longitudinally extending support member is engaged with all the transverse load bearing members and at least a portion of the transverse vehicular load bearing members ("center-beams") is further connected to an additional longitudinally extending support bar member that is dedicated to the transverse load bearing member to which it is connected. The load bearing members' connection to the single support bar member may be through a yoke assembly. The yoked connection of the single support bar member to a plurality of transverse load bearing members provides a sliding or pivoting connection in the modular expansion joint system.

The vehicular load bearing members that are further connected to an additional longitudinally extending support bar member that is dedicated to the transverse load bearing member to which it is connected may be connected through a rigid connection. Without limitation, and only be way of illustration, the vehicular load bearing members that are further connected to an additional longitudinally extending support bar member are connected to the support bar member through a weld.

Certain illustrative embodiments of the expansion joint system will now be described in greater detail with reference to the FIGURE. It should be noted that the expansion joint system is not intended to be limited to the illustrative embodiments shown in the FIGURE, but shall include all variations and modifications within the scope of the claims.

FIG. 1 shows the underside of an illustrative embodiment of the expansion joint system 10 that is designed for positioning within a gap formed between two spaced-apart sections of roadway. In the illustrative embodiment shown in FIG. 1, the expansion joint system 10 includes a plurality of vehicle load bearing members 12-24 that extend transversely in the gap in relation to the direction of the flow of vehicular traffic across the expansion joint system 10 and gap. While the illustrative embodiment shown in FIG. 1 shows thirteen transversely extending load bearing members, it should be noted that any number of such transversely extending vehicular load bearing members may be used in the expansion joint system depending, on the size of the gap and the movement desired to be accommodated. The vehicular load bearing members 12-24 are generally positioned in a side-by-side relationship and extend transversely in the expansion joint relative to the direction of vehicle travel. The top surface(s) of the vehicular load bearing members 12-24 are adapted to support vehicle tires as a vehicle passes over the expansion joint. The expansion joint system 10 also includes edge members 26, 28 that are adapted to be engaged to the spaced-apart structural members that for the expansion joint gap.

According to certain embodiments, the vehicular load bearing members 12-24 have a generally square or rectangular cross-section. It should be noted, however, that the load bearing members are not limited to members having approximately square or rectangular cross sections, but, rather, the load bearing members may comprise any number of cross sectional configurations or shapes. The shape of the cross section of load bearing members is only limited in that the shape of the load hearing members must be capable of providing relatively smooth and unimpeded vehicular traffic across the top surfaces of the load bearing members.

Still referring to the illustrative embodiment shown in FIG. 1, the expansion joint system 10 includes a plurality of elongated support bar members 29-35 that are positioned below the vehicular load bearing member 12-24 within the expansion joint gap. Elongated support bar members 29-35 extend longitudinally in the gap in relation to the direction of the flow of vehicular traffic across the expansion joint system 10 and gap. In the embodiment shown, the system 10 includes seven elongated longitudinally extending support bar members. It should be noted, however, that any number of such longitudinally extending support bar members may be used in the expansion joint system depending on the size of the gap and the movement desired to be accommodated.

Still referring to FIG. 1, elongated support bar members 29-35 are positioned in a side-by-side relationship within the expansion joint gap. Longitudinally extending elongated support member 32 is flanked on both sides by elongated support bar members 29-31 on one side and elongated support bar members 33-35 on the other side. Elongated support bar member 32 is movably engaged, utilizing for example, a yoke assembly 40, with all of said plurality of transverse load bearing members 12-24 of the system 10 and constitutes the single support bar modular portion of the hybrid single/multiple support bar modular expansion joint system 10. Transverse vehicular load bearing members 12-14 and 22-24 are further independently and separately rigidly connected, utilizing for example, a weld connection 42, to one of the longitudinally extending support bar members 29-31 or 33-35.

The independent and separate connection of transverse vehicular load bearing members 12-14 and 22-24 to one of the longitudinally extending support bar members constitutes the multiple support bar modular portion of the hybrid single/multiple support bar modular system. As shown in FIG. 1, transverse load bearing member 12 is connected to elongated support bar member 35, transverse load bearing member 13 is connected to elongated support bar member 34, transverse load bearing member 14 is connected to elongated support bar member 33, transverse load bearing member 22 is connected to elongated support bar member 29, transverse load bearing member 23 is connected to elongated support bar member 30, and transverse load bearing member 24 is connected to elongated support bar member 31.

The hybrid single/multiple support bar modular system establishes different zones of movement within the system. According to the construction of the expansion joint system shown in FIG. 1, first zones Z1 are created in which the movement of the vehicular load bearing members in the first zones Z1 occurs in response to a first level of movement of the structure. Zones Z1 may be referred to as substantially "active" zones in which transverse load bearing members 12-14 and 22-24 are designed to move easily in response to structural movement. Third zone Z3 is created in which the movement of the vehicular load bearing members in the zone Z3 occurs in response to a different level of movement of the structure. Zone Z3 may be referred to as a substantially "passive" zone in which transverse load bearing members 17-19 are designed to move only in response to extreme structural movement. Zones Z2 are created in which the movement of the vehicular load bearing members in the zone Z3 occurs in response to yet a different level of movement of the structure. Zone Z3 may be referred to as a "semi-active" zone in which transverse load bearing members 15, 16 and 20, 21 are designed to move in response to structural movement that is greater than the movement required to cause movement of members 12, 14 and 22-24 in zones Z1 and less that the movement required to cause movement of members 17-19 in zone Z3. The three zones can accommodate daily harmonic cycling, seasonal cycling and ULS requirements.

The system of equations for the design of the hybrid single support bar/multiple support bar hybrid modular expansion joint system as shown in illustrative FIG. 1 are as follows:

$$m\cdot\ddot{x}_1+k_{Z1}\cdot(x_1-x_{LE})+k_{Z1}\cdot(x_2-x_1)+f_{LE}(\dot{x}_1-\dot{x}_{LE})+f_{RE}(\dot{x}_1-\dot{x}_{RE})=0$$

$$m\cdot\ddot{x}_2+k_{Z1}\cdot(x_2-x_1)+k_{Z1}\cdot(x_3-x_2)+f_{LE}(\dot{x}_2-\dot{x}_{LE})+f_{RE}(\dot{x}_2-\dot{x}_{RE})=0$$

$$m\cdot\ddot{x}_3+k_{Z1}\cdot(x_3-x_2)+k_{Z12}\cdot(x_4-x_3)+f_{LE}(\dot{x}_3-\dot{x}_{LE})+f_{RE}(\dot{x}_3-\dot{x}_{RE})=0$$

$$m\cdot\ddot{x}_4+k_{Z12}\cdot(x_4-x_3)+k_{Z2}\cdot(x_5-x_4)+f_{yZ2}(\dot{x}_4)=0$$

$$m\cdot\ddot{x}_5+k_{Z2}\cdot(x_5-x_4)+k_{Z23}\cdot(x_6-x_5)+f_{yZ2}(\dot{x}_5)=0$$

$$m\cdot\ddot{x}_6+k_{Z23}\cdot(x_6-x_5)+k_{Z3}\cdot(x_7-x_6)+f_{yZ3}(\dot{x}_6)=0$$

$$m\cdot\ddot{x}_7+k_{Z3}\cdot(x_7-x_6)+k_{Z3}\cdot(x_8-x_7)+f_{yZ3}(\dot{x}_7)=0$$

$$m\cdot\ddot{x}_8+k_{Z3}\cdot(x_8-x_7)+k_{Z23}\cdot(x_9-x_8)+f_{yZ3}(\dot{x}_8)=0$$

$$m\cdot\ddot{x}_9+k_{Z23}\cdot(x_9-x_8)+k_{Z2}\cdot(x_{10}-x_9)+f_{yZ2}(\dot{x}_9)=0$$

$$m\cdot\ddot{x}_{10}+k_{Z2}\cdot(x_{10}-x_9)+k_{Z12}\cdot(x_{11}-x_{10})+f_{yZ2}(\dot{x}_{10})=0$$

$$m\cdot\ddot{x}_{11}+k_{Z12}\cdot(x_{11}-x_{10})+k_{Z1}\cdot(x_{12}-x_{11})+f_{LE}(\dot{x}_{11}-\dot{x}_{LE})+f_{RE}(\dot{x}_{11}-\dot{x}_{RE})=0$$

$$m\cdot\ddot{x}_{12}+k_{Z1}\cdot(x_{12}-x_{11})+k_{Z1}\cdot(x_{13}-x_{12})+f_{LE}(\dot{x}_{12}-\dot{x}_{LE})+f_{RE}(\dot{x}_{12}-\dot{x}_{RE})=0$$

$$m\cdot\ddot{x}_{13}+k_{Z1}\cdot(x_{13}-x_{12})+k_{Z1}\cdot(x_{RE}-x_{13})+f_{LE}(\dot{x}_{13}-\dot{x}_{LE})+f_{RE}(\dot{x}_{13}-\dot{x}_{RE})=0$$

wherein m=transverse load bearing member ("centerbeam") lumped mass k=equidistance spring rate $f_{LE}$=friction force on support bar at left edge $f_{RE}$=friction force on support bar at right edge $f_y$=yoke friction The expansion joint system may be used in the gap between adjacent concrete roadway sections. The concrete is typically poured into the blockout portions of adjacent roadway sections. The gap is provided between first and second roadway sections to accommodate expansion and contraction due to thermal fluctuations and seismic cycling. The expansion joint system can be affixed within the block-out portions between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

The expansion joint system may be utilized where it is desirable to absorb loads applied to the expansion joint systems, and to accommodate movements that occur in the vicinity of the expansion joint gap in response to temperature changes, seismic cycling and deflections caused by vehicular loads. The expansion joint system is able to accommodate movements that occur separately or simultaneously in multiple directions in the vicinity of a gap having an expansion joint between two adjacent roadway sections, for example, movements occurring in longitudinal and transverse directions relative to the flow of traffic, and which are a result of thermal changes, prestressing, seismic events, and vehicular load deflections.

While the expansion joint system has been described above in connection with the certain illustrative embodiments, as shown in the drawing FIGURE, it is to be understood that other similar embodiments may be used or modifications and additions may be made to the described embodiments for performing the same function of the expansion joint system without deviating therefrom. Further, all embodiments disclosed are not necessarily in the alternative, as various embodiments may be combined to provide the desired characteristics. Variations can be made by one having ordinary skill in the art without departing from the spirit and scope of the disclosure.

The invention claimed is:

1. An expansion joint system for a gap defined between adjacent first and second structures comprising:

a plurality of transversely extending vehicular load bearing members having top surfaces exposed to traffic and bottom surfaces opposite said top surfaces;

a plurality of support members positioned below said transversely extending load bearing members and extending longitudinally across said expansion joint from said first structure to said second structure; Wherein at least one of said plurality of longitudinally extending support members is movably engaged with all of said plurality of transverse load bearing members and at least one of said transversely extending vehicular load bearing members is fixedly connected to only one of said longitudinally extending support bar members; and housings for accepting opposite ends of said plurality of support members;

wherein said expansion joint system comprises a plurality of zones wherein movement of the vehicular load bearing members in a particular zone occurs in response to a different level of movement within the structure.

2. The expansion joint system of claim 1, wherein said zones comprise at least one first zone in which the movement of the vehicular load bearing members in the first zone occurs in response to a first level of movement of the structure and at least one second zone in which the movement of the vehicular load bearing members in the second zone occurs in response to a second level of movement of the structure which is greater than the first level of movement of the structure.

3. The expansion joint system of claim 1, wherein said zones comprise:

at least one first zone in which the movement of the vehicular load bearing members in the first zone occurs in response to a first level of movement of the structure, at least one second zone in which the movement of the vehicular load bearing members in the second zone occurs in response to a second level of movement of the structure which is greater than the first level of movement of the structure; and at least one third zone in which the movement of the vehicular load bearing members in the third zone occurs in response to a third level of movement of the structure which is greater than both the first and second levels of movement of the structure.

4. The expansion joint system of claim 1, wherein said at least one longitudinally extending support member that is movably engaged with all of said plurality of transverse load bearing members is connected to each transverse load bearing member by a yoke assembly.

5. The expansion joint of claim 4, wherein said yoke assembly comprises a substantially U-shaped cross-section.

6. The expansion joint system of claim 5, wherein each yoke assembly is mechanically attached to one of said plurality of load bearing members.

7. The expansion joint system of claim 6, wherein said mechanical attachment comprises a mechanical fastener.

8. The expansion joint system of claim 6, wherein said mechanical attachment comprises a weld.

9. The expansion joint system of claim 1, wherein said housing comprise:

first housings for accepting an end of said elongated support members for substantially restricting transverse movement within said first housings, but permitting longitudinal and vertical movement within said first housings; and second housings for accepting an end of said one elongated support members for substantially restricting longitudinal movement within said second housings, but permitting transverse and vertical movement within said second housing.

10. The expansion joint system of claim 9, wherein said housings are structures selected from the group consisting of boxes, receptacles, chambers, containers, enclosures, channels, tracks, slots, grooves and passages.

11. The expansion joint system of claim 1, comprising flexible and compressible seals extending between at least two of said load bearing members, and between said load bearing members and edge sections of said first and said second roadway sections.

12. The expansion joint system of claim 11, wherein said seals are selected from strip seals, glandular seals, and membrane seals.

13. An expansion joint comprising:

spaced-part structural members; and an expansion joint system bridging the gap between the structural members, wherein the expansion joint system comprises a plurality of vehicle load bearing members extending transverse to the direction of traffic crossing the expansion joint gap;

a plurality of elongated support members that are positioned below the transversely extending load bearing members and extend longitudinally across the expansion joint gap;

wherein at least one of said plurality of longitudinally extending support members is movably engaged with all of said plurality of transverse load bearing members and at least one of said transversely extending vehicular load bearing members is fixedly connected to only one of said longitudinally extending support bar members; housings for receiving the opposite longitudinal ends of the elongated support bar members; and wherein said expansion joint system comprises a plurality of zones wherein movement of the vehicular load bearing members in a particular zone occurs in response to a different level of movement within the structure.

14. The expansion joint of claim 13, wherein said zones comprise at least one first zone in which the movement of the vehicular load bearing members in the first zone occurs in response to a first level of movement of the structure and at least one second zone in which the movement of the vehicular load bearing members in the second zone occurs in response to a second level of movement of the structure which is greater than the first level of movement of the structure.

15. The expansion joint of claim 13, wherein said at least one longitudinally extending support member that is engaged with all of said plurality of transverse load bearing members is connected to each transverse load bearing member by a yoke assembly.

* * * * *

UNITED STATES PATENT AND TRADEMARK OFFICE

CERTIFICATE OF CORRECTION

PATENT NO. : 8,376,652 B2
APPLICATION NO. : 12/965331
DATED : February 19, 2013
INVENTOR(S) : Bradford It is certified that error appears in the above-identified patent and that said Letters Patent is hereby corrected as shown below:

In column 10, lines 33-37, Claim 15, the word "movably" is omitted. Claim 15 should read:

15. The expansion joint of claim 13, wherein said at least one longitudinally extending support member that is movably engaged with all of said plurality of transverse load bearing members is connected to each transverse load bearing member by a yoke assembly.

Signed and Sealed this
Ninth Day of April, 2013

Teresa Stanek Rea
*Acting Director of the United States Patent and Trademark Office*